US010968076B2

(12) United States Patent
Convard et al.

(10) Patent No.: US 10,968,076 B2
(45) Date of Patent: Apr. 6, 2021

(54) ELEVATOR MAINTENANCE FROM INSIDE ELEVATOR CAR

(71) Applicant: Otis Elevator Company, Farmington, CT (US)

(72) Inventors: Emmanuel Convard, La Bussiere (FR); Frédéric Beauchaud, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 577 days.

(21) Appl. No.: 15/748,016

(22) PCT Filed: Jul. 28, 2015

(86) PCT No.: PCT/IB2015/001885

§ 371 (c)(1),
(2) Date: Jan. 26, 2018

(87) PCT Pub. No.: WO2017/017493

PCT Pub. Date: Feb. 2, 2017

(65) Prior Publication Data

US 2018/0215580 A1 Aug. 2, 2018

(51) Int. Cl.
*B66B 5/00* (2006.01)
*B66B 1/28* (2006.01)
(Continued)

(52) U.S. Cl.
CPC ..... *B66B 5/0087* (2013.01); *B66B 1/28* (2013.01); *B66B 1/3407* (2013.01);
(Continued)

(58) Field of Classification Search
CPC ... B66B 5/0087; B66B 1/3492; B66B 5/0025; B66B 5/0018; B66B 5/0037;
(Continued)

(56) References Cited

U.S. PATENT DOCUMENTS 4,411,577 A 10/1983 Shearer, Jr.
4,683,990 A * 8/1987 Wright ..... B66B 3/02 187/394

(Continued)

FOREIGN PATENT DOCUMENTS

EP 1031528 A1 8/2000
EP 2114810 A1 11/2009

(Continued)

OTHER PUBLICATIONS

International Search Report for International Application No. PCT/IB2015/001885; International Filing Date Jul. 28, 2015; dated May 10, 2016; 6 Pages.

(Continued)

*Primary Examiner* — Marlon T Fletcher

(74) *Attorney, Agent, or Firm* — Cantor Colburn LLP

(57) ABSTRACT

A method of operating an elevator system (10) includes identifying one or more components (46, 48, 50, 52) in an elevator hoistway (14) requiring periodic maintenance and/or inspection and programming hoistway component locations of the one or more components into an elevator car control system. The elevator car (12) is driven to a programmed hoistway component location of a selected component of the one or more components utilizing the hoistway component location programmed into the elevator car control system. The selected component is accessed from inside the elevator car (12) to perform maintenance and/or inspection of the selected component.

14 Claims, 4 Drawing Sheets

(51) Int. Cl.
*B66B 1/34* (2006.01)
*B66B 9/00* (2006.01)
*B66B 11/02* (2006.01)

(52) U.S. Cl.
CPC ..... *B66B 1/3492* (2013.01); *B66B 9/00* (2013.01); *B66B 11/0246* (2013.01); *B66B 2201/00* (2013.01)

(58) Field of Classification Search
CPC ... B66B 11/0246; B66B 13/12; B66B 1/3415; B66B 5/0006; B66B 13/08; B66B 11/0005; B66B 25/006; B66B 1/466; D07B 2501/2007
See application file for complete search history.

(56) References Cited

U.S. PATENT DOCUMENTS 4,930,604 A * 6/1990 Schienda ..... B66B 5/0006 187/393
6,223,861 B1 * 5/2001 Sansevero ..... B66B 13/22 187/316
6,230,846 B1 * 5/2001 Namba ..... B66B 11/002 187/394
6,405,834 B1 6/2002 Chida et al.
6,701,277 B2 3/2004 Coste et al.
6,739,432 B2 * 5/2004 Elsener ..... B66B 11/0246 187/401
8,316,998 B2 * 11/2012 Henseler ..... B66B 5/0087 187/401
8,418,815 B2 4/2013 Encinas Carreno et al.
2008/0047783 A1 2/2008 Vogl
2008/0156591 A1 * 7/2008 Tracey ..... B66B 1/40 187/394
2011/0240414 A1 * 10/2011 Carreno ..... B66B 5/0025 187/390
2012/0305334 A1 12/2012 Kocher et al.
2013/0025975 A1 * 1/2013 Guillot ..... B66B 7/027 187/359
2013/0233655 A1 * 9/2013 Peacock ..... B66B 20/00 187/414
2014/0076667 A1 3/2014 Henseler
2014/0182974 A1 * 7/2014 Puranen ..... B66B 5/0018 187/247
2014/0216856 A1 8/2014 Hovi et al.
2015/0008076 A1 1/2015 Muller et al.
2015/0336768 A1 * 11/2015 Otsuka ..... B66B 1/36 187/394
2018/0215580 A1 * 8/2018 Convard ..... B66B 11/0246
2018/0327221 A1 * 11/2018 Sudi ..... B66B 1/3492
2019/0100410 A1 * 4/2019 Mezzadri ..... B66B 11/0246
2019/0300336 A1 * 10/2019 Witczak ..... B66B 1/28
2020/0109031 A1 * 4/2020 Lahteenmaki ..... B66B 11/0407

FOREIGN PATENT DOCUMENTS

JP 06321447 A 11/1994
JP 11011811 1/1999
JP 2006335511 12/2006
JP 2007091430 A 4/2007
WO 0179104 A1 10/2001
WO 02102701 A1 12/2002
WO 2007046385 A1 4/2007
WO 2008095324 A1 8/2008

OTHER PUBLICATIONS

Written Opinion for International Application No. PCT/IB2015/001885; International Filing Date Jul. 28, 2015; dated May 10, 2016; 6 Pages.

* cited by examiner

ELEVATOR MAINTENANCE FROM INSIDE ELEVATOR CAR

CROSS REFERENCE TO RELATED APPLICATIONS

This application is a National Stage application of PCT/IB2015/001885, filed Jul. 28, 2015, the entire contents of which are hereby incorporated by reference.

BACKGROUND

The subject matter disclosed herein relates to elevator systems. More particularly, the present disclosure relates to hoistway access control for technicians and/or maintenance personnel.

In current, typical elevator systems, technicians or maintenance personnel often enter the hoistway above or underneath of the elevator car to access elevator system components in the hoistway or to perform maintenance in the hoistway, by entering the hoistway through a hoistway door. In order to protect the mechanics or technicians, etc., during those operations, codes and/or regulations have specified a safety volume and clearance for technicians entering the hoistway resulting in a larger overall volume of the elevator systems. Elevator system customers, however, desire that the elevator system occupy a smaller overall volume. Thus, new elevator systems are being developed in which many maintenance activities can be performed from inside the car, alleviating the need to provide such a safety volume in the pit and/or at a top of the hoistway.

BRIEF SUMMARY

In one embodiment, a method of operating an elevator system includes identifying one or more components in an elevator hoistway requiring periodic maintenance and/or inspection and programming hoistway component locations of the one or more components into an elevator car control system. The elevator car is driven to a programmed hoistway component location of a selected component of the one or more components utilizing the hoistway component location programmed into the elevator car control system. The selected component is accessed from inside the elevator car to perform maintenance and/or inspection of the selected component.

Additionally or alternatively, in this or other embodiments programming the hoistway component locations of the one or more components includes driving the elevator car to the hoistway component location, and recording a sensed hoistway component location into the elevator car control system, the sensed hoistway component location indicative of the hoistway component location.

Additionally or alternatively, in this or other embodiments the hoistway component location is sensed by a machine encoder and/or a position reference system (PRS) of the elevator system.

Additionally or alternatively, in this or other embodiments the PRS utilizes a sensed element placed at each component of the one or more components to determine the sensed hoistway component location.

Additionally or alternatively, in this or other embodiments a unique code is assigned for each hoistway component location in the elevator car control system.

Additionally or alternatively, in this or other embodiments the unique code for the selected component is entered into the elevator car control system to initiate driving of the elevator car to the programmed hoistway component location.

Additionally or alternatively, in this or other embodiments the one or more components include one or more of an electrical box, a hoistway light or a counterweight.

Additionally or alternatively, in this or other embodiments the elevator car control system comprises a car operating panel (COP) disposed in the elevator car.

In another embodiment, an elevator system includes a hoistway and an elevator car drivable along the hoistway. One or more elevator system components are positioned in the hoistway and are selectable for maintenance and/or inspection. An elevator car control system is configured to receive hoistway component locations of the one or more elevator system components, and selectably drive the elevator car to a location of a selected component of the one or more components utilizing the hoistway component location received into the elevator car control system. When the elevator car is driven to the hoistway component location, the selected component is accessible from inside the elevator car to perform maintenance and/or inspection of the selected component.

Additionally or alternatively, in this or other embodiments the hoistway locations are input into the elevator car control system by driving the elevator car to the hoistway component location and recording a sensed hoistway component location into the elevator car control system, the sensed hoistway component location indicative of the hoistway component location.

Additionally or alternatively, in this or other embodiments a machine encoder and/or a position reference system (PRS) of the elevator system to sense the hoistway component location.

Additionally or alternatively, in this or other embodiments a sensed element is positioned at each component of the one or more elevator system components and is utilized by the PRS to determine the sensed hoistway component location.

Additionally or alternatively, in this or other embodiments the elevator car control system is configured to assign a unique code for each hoistway component location in the elevator car control system.

Additionally or alternatively, in this or other embodiments when the unique code for the selected component is entered into the elevator car control system, the elevator car control system initiates driving of the elevator car to the programmed hoistway component location.

Additionally or alternatively, in this or other embodiments the one or more components include one or more of an electrical box, a hoistway light or a counterweight.

Additionally or alternatively, in this or other embodiments the elevator car control system comprises a car operating panel (COP) disposed in the elevator car.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
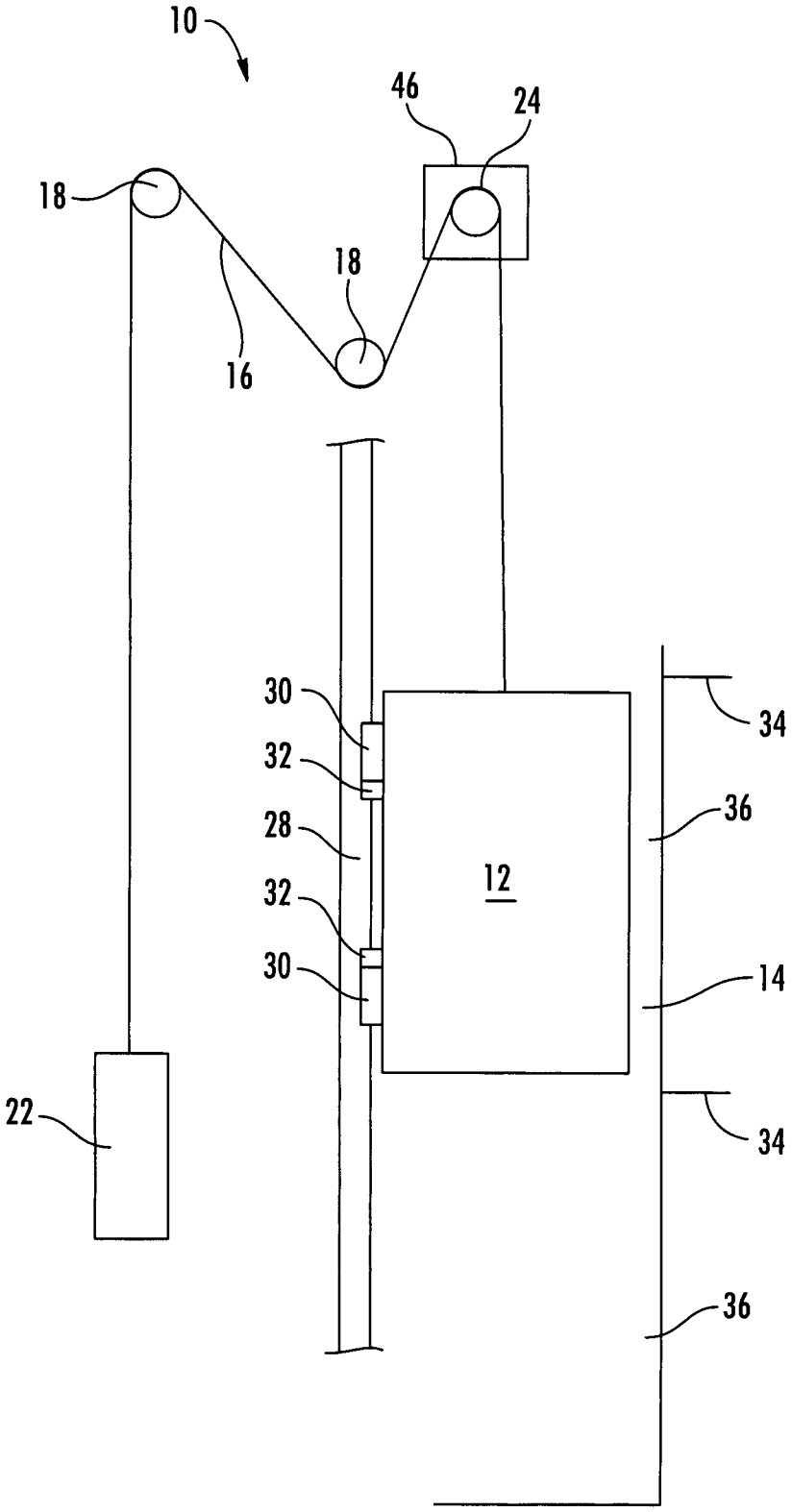
FIG. 1 is a schematic view of an embodiment of an elevator system.

Shown in FIG. 1 is a schematic of an exemplary traction elevator system 10. The elevator system 10 includes an elevator car 12 operatively suspended or supported in a hoistway 14 with one or more suspension members 16, such as ropes or belts. The one or more suspension members 16 interact with one or more sheaves 18 to be routed around various components of the elevator system 10. The one or more sheaves 18 could also be connected to a counterweight 22, which is used to help balance the elevator system 10 and reduce the difference in suspension member 16 tension on both sides of a traction sheave 24 during operation.

The elevator system 10 further includes one or more guide rails 28 to guide the elevator car 12 along the hoistway 14. The elevator car 12 includes one or more guide shoes or rollers 30 interactive with the guide rails 28 to guide the elevator car 12. The elevator car 12 also may include safeties 32 interactive with the guide rail 28 to slow and/or stop motion of the elevator car 12 under certain conditions, such as an overspeed condition.

The hoistway 14 includes one or more landing floors 34 at which the elevator car 12 stops to allow ingress and/or egress of passengers from the elevator car 12 through elevator car doors (not shown). A landing floor door 36 is located at each landing floor 34 of the hoistway 14. During elevator system operation, the landing floor door 36 opens when the elevator car 12 is present at the landing floor 34 to allow for passenger ingress and/or egress.

Figure 2:
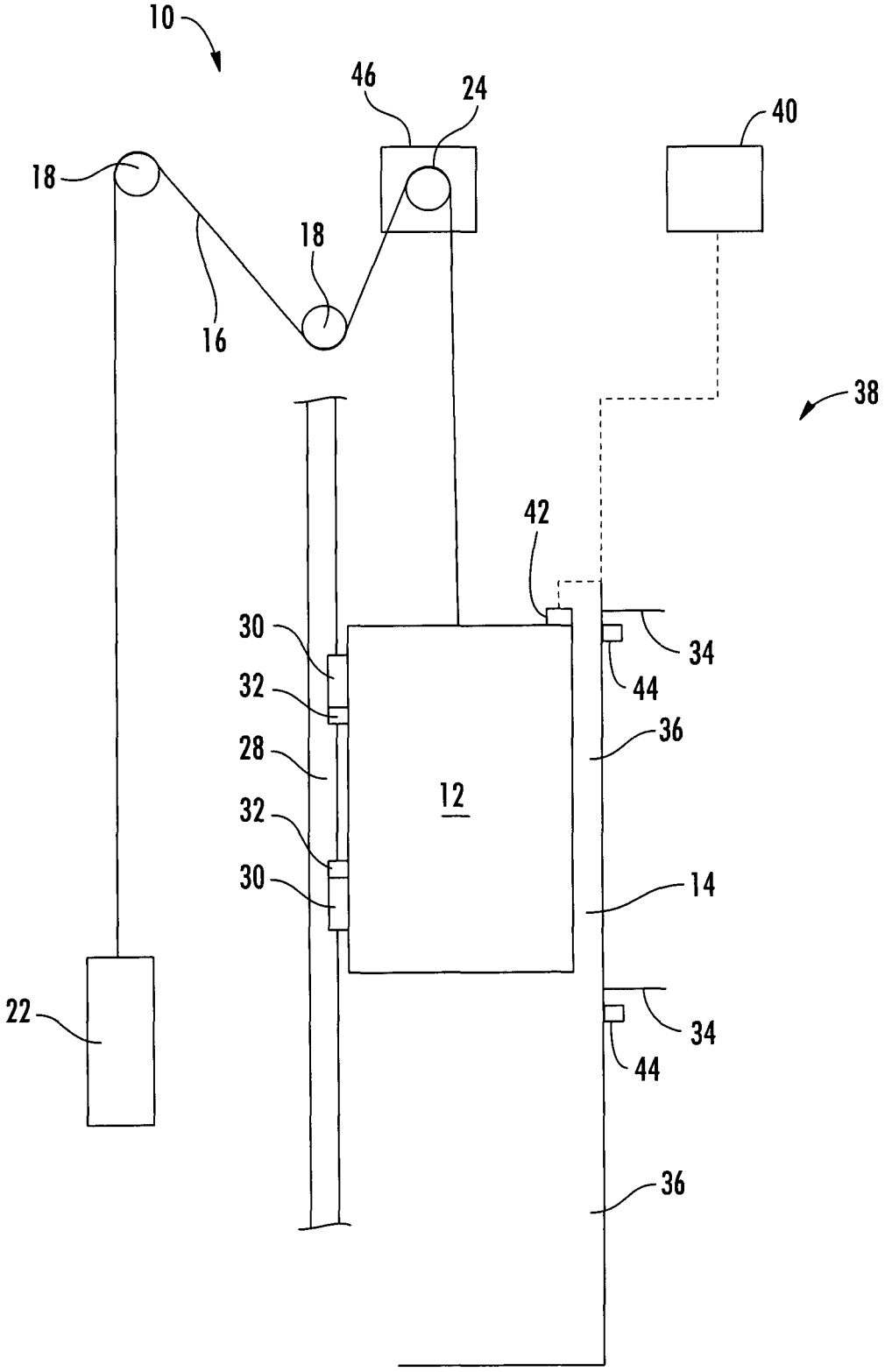
FIG. 2 is another schematic view of an embodiment of an elevator system.

Referring to FIG. 2, the elevator system 10 further utilizes a position reference system (PRS) 38. The PRS 38 is utilized by an elevator control system 40 to determine a position of the elevator car 12 in the hoistway 14. Some PRS 38 accurately determine the elevator car position to within 3 to 5 millimeters. A PRS 38 includes a car reader 42 fixed to the elevator car 12, and a plurality of sensed elements 44, such as magnets or switches, fixed in the hoistway 14 at components such as landing floor door frames, guide rails 28, or a steel band installed along the entire rise of the hoistway 14, positioned such that the car reader 42 can interact with the sensed elements 44 to determine the position of the elevator car 12. After an initial programming, the elevator car 12 can detect the relative position between the car reader 42 and a particular sensed element 44.

Figure 3:
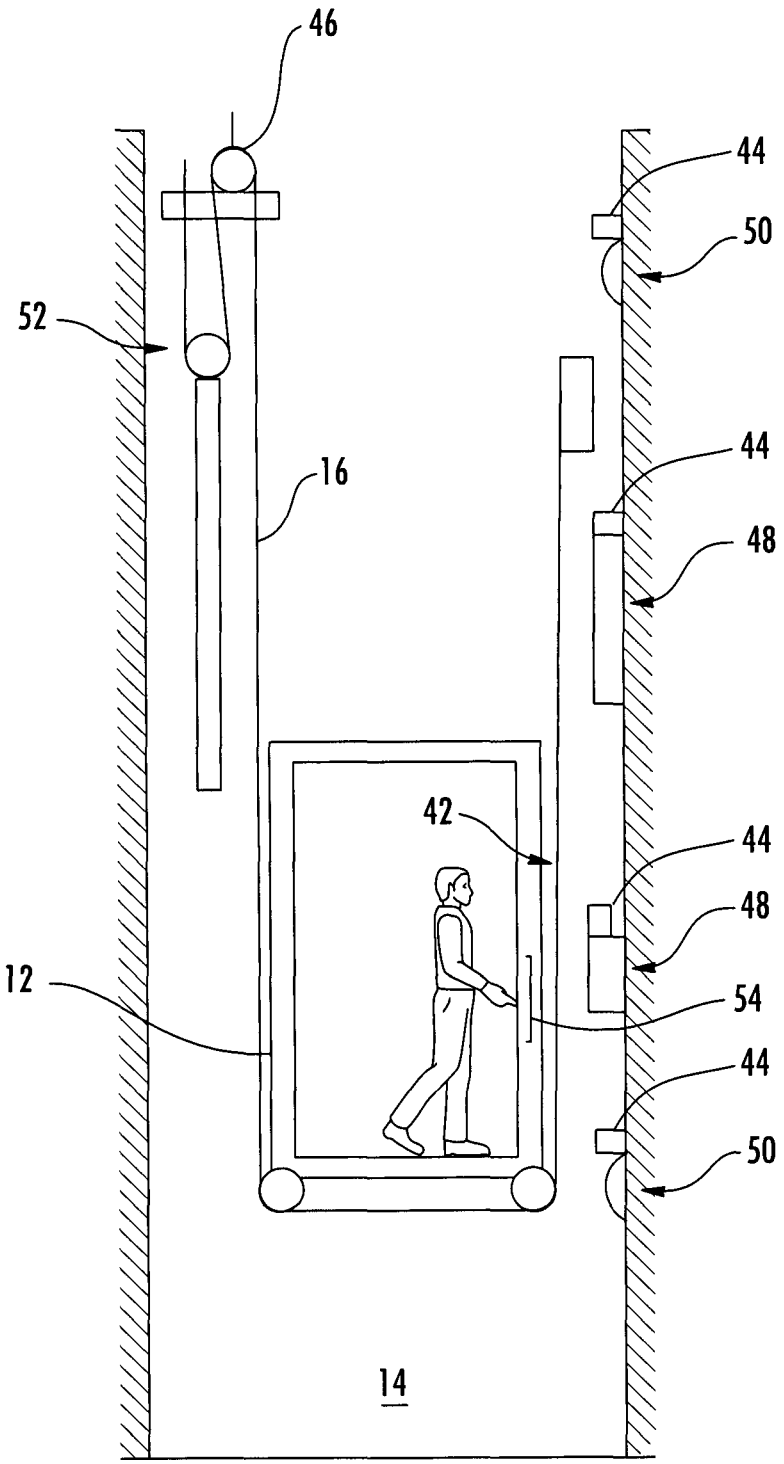
FIG. 3 is a schematic view of operation of an elevator system for inspection and/or maintenance.

Referring now to FIG. 3, as it is desired to perform maintenance activities on hoistway components from within the elevator car 12, via an access panel, door or other opening, it is desired to have the ability to drive the elevator car 12 directly to selected components in the hoistway with great accuracy. In one embodiment, this is accomplished by utilizing the PRS 38 to record positions of selected components in the hoistway 14. The components may include, for example, a machine 46, an electrical box 48, a hoistway light 50, a counterweight top 52, or other components in the hoistway 14 that may require periodic inspection and/or maintenance. Sensed elements 44 are placed in the hoistway 14 at their respective hoistway component locations. The PRS 38 is then programmed to recognize the sensed elements 44 of the components. For example, the elevator car 12 may be driven to the hoistway component location such that the car reader 42 aligns with the sensed element 44. The hoistway component location is recorded by the PRS 38 and assigned a location code. This process is repeated for each of the components. Once programming is complete, the elevator car 12 may be driven to a selected hoistway component location for inspection or maintenance of a selected component by, for example, entering the location code into a car operating panel (COP) 54, utilizing a special maintenance key, or by utilizing another service tool.

Figure 4:
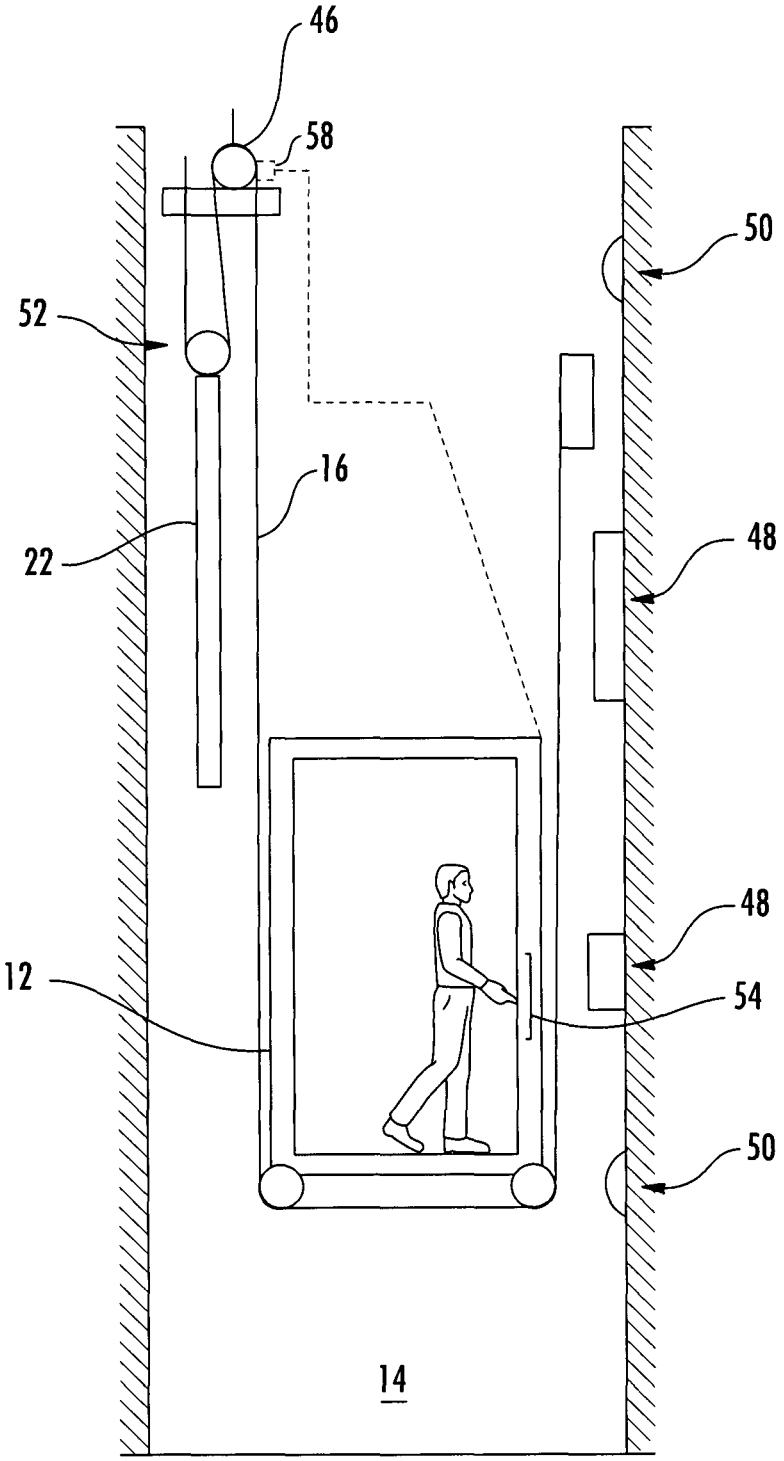
FIG. 4 is another schematic view of operation of an elevator system for inspection and/or maintenance.

Alternatively, as shown in FIG. 4, the elevator system 10 may utilize a machine encoder 58 at the machine 46 to track location of the elevator car 12 in the hoistway 14. To program the COP 54 in this case, the hoistway component locations of each component as indicated by the machine encoder are entered into the COP 54 and again assigned with each component assigned a location code. This process is repeated for each of the components. Once programming is complete, the elevator car 12 may be driven to a selected hoistway component location for inspection or maintenance of a selected component by, for example, entering the location code into the car operating panel (COP) 54, utilizing a special maintenance key, or by utilizing another service tool.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method of operating an elevator system comprising:
- identifying one or more components in an elevator hoistway requiring periodic maintenance and/or inspection;
- programming hoistway component locations of the one or more components into an elevator car control system;
- driving the elevator car to a programmed hoistway component location of a selected component of the one or more components utilizing the hoistway component location programmed into the elevator car control system; and
- accessing the selected component from inside the elevator car to perform maintenance and/or inspection of the selected component;
- wherein programming the hoistway component locations of the one or more components includes:
  - driving the elevator car to the hoistway component location; and
  - recording a sensed hoistway component location into the elevator car control system, the sensed hoistway component location indicative of the hoistway component location.

2. The method of claim 1, wherein the hoistway component location is sensed by a machine encoder and/or a position reference system (PRS) of the elevator system.

3. The method of claim 2, wherein the PRS utilizes a sensed element placed at each component of the one or more components to determine the sensed hoistway component location.

4. The method of claim 1, further comprising assigning a unique code for each hoistway component location in the elevator car control system.

5. The method of claim 4, further comprising entering the unique code for the selected component into the elevator car control system to initiate driving of the elevator car to the programmed hoistway component location.

6. The method of claim 1, wherein the one or more components include one or more of an electrical box, a hoistway light or a counterweight.

7. The method of claim 1, wherein the elevator car control system comprises a car operating panel (COP) disposed in the elevator car.

8. An elevator system comprising:

a hoistway;

an elevator car drivable along the hoistway;

one or more elevator system components disposed in the hoistway selectable for maintenance and/or inspection; and an elevator car control system configured to:

receive hoistway component locations of the one or more elevator system components; and selectably drive the elevator car to a location of a selected component of the one or more components utilizing the hoistway component location received into the elevator car control system;

wherein when the elevator car is driven to the hoistway component location, the selected component is accessible from inside the elevator car to perform maintenance and/or inspection of the selected component;

wherein the hoistway locations are input into the elevator car control system by:

driving the elevator car to the hoistway component location; and recording a sensed hoistway component location into the elevator car control system, the sensed hoistway component location indicative of the hoistway component location.

9. The elevator system of claim 8, further comprising a machine encoder and/or a position reference system (PRS) of the elevator system to sense the hoistway component location.

10. The elevator system of claim 9, further comprising a sensed element disposed at each component of the one or more elevator system components utilized by the PRS to determine the sensed hoistway component location.

11. The elevator system of claim 8, wherein the elevator car control system is configured to assign a unique code for each hoistway component location in the elevator car control system.

12. The elevator system of claim 11, wherein when the unique code for the selected component is entered into the elevator car control system, the elevator car control system initiates driving of the elevator car to the programmed hoistway component location.

13. The elevator system of claim 8 wherein the one or more components include one or more of an electrical box, a hoistway light or a counterweight.

14. The elevator system of claim 8, wherein the elevator car control system comprises a car operating panel (COP) disposed in the elevator car.

* * * * *